United States Patent [19]

Isozumi et al.

[11] Patent Number: 4,899,603

[45] Date of Patent: Feb. 13, 1990

[54] STARTING ELECTRIC MOTOR

[75] Inventors: Shuzoo Isozumi; Keiichi Konishi; Akira Morishita, all of Hyogo, Japan

[73] Assignee: Mitsubishi Denki Kabushiki Kaisha, Tokyo, Japan

[21] Appl. No.: 238,432

[22] Filed: Aug. 31, 1988

[30] Foreign Application Priority Data

Aug. 31, 1987 [JP] Japan ..... 62-133385[U]
Aug. 31, 1987 [JP] Japan ..... 62-133386[U]

[51] Int. Cl.[4] ..... F02N 15/06

[52] U.S. Cl. ..... 74/6; 74/7 A; 74/7 C; 192/42

[58] Field of Search ..... 74/7 A, 7 C, 7 E, 7 R, 74/6; 192/42; 384/279, 298, 902

[56] References Cited

U.S. PATENT DOCUMENTS

| | | | |
|---|---|---|---|
| 1,359,954 | 11/1920 | Bendix | 74/7 E |
| 1,561,685 | 11/1925 | Bijur | 74/7 E |
| 1,575,698 | 3/1926 | McGrath | 74/7 E |
| 1,707,488 | 4/1929 | McGrath | 74/7 E |
| 3,182,515 | 5/1965 | Klein | 74/7 R |
| 3,620,133 | 11/1971 | Feucht | 92/33 |
| 3,690,188 | 9/1972 | McMillen | 74/7 R |
| 3,791,685 | 2/1974 | Hamman | 290/37 X |
| 4,274,292 | 6/1981 | Arnett, Jr. | 74/7 E |
| 4,304,140 | 12/1981 | Ebihara | 74/7 A |
| 4,404,533 | 9/1983 | Kurihara et al. | 335/131 |
| 4,507,978 | 4/1985 | Tanaka et al. | 74/7 E |
| 4,613,761 | 9/1986 | Yabunaka | 290/36 R |
| 4,665,320 | 5/1987 | DeBello | 290/48 |

FOREIGN PATENT DOCUMENTS

| | | |
|---|---|---|
| 2801571 | 1/1979 | Fed. Rep. of Germany . |
| 2904543 | 8/1980 | Fed. Rep. of Germany . |
| 2222881 | 10/1974 | France . |

*Primary Examiner*—Leslie A. Braun
*Assistant Examiner*—Janice E. Chartoff
*Attorney, Agent, or Firm*—Sughrue, Mion, Zinn, Macpeak & Seas

[57] ABSTRACT

In an overhung type starting electric motor, a pinion part of a movable pinion cylinder is made smaller in inside diameter than a clutch inner part and a cylindrical part thereof, and a stepped part is provided between a helical spline part and the small diameter part of a rotary shaft in such a manner that a very small gap is formed between the stepped part and the inner cylindrical wall of the clutch inner part of the movable pinion cylinder, and a very small gap is formed also between the small diameter part of the rotary shaft and the inner cylindrical wall of the pinion part of the movable piston cylinder. A misalignment preventing ring is fitted in the clutch outer of an overrunning clutch to be slidable on the stepped part.

7 Claims, 2 Drawing Sheets

STARTING ELECTRIC MOTOR

BACKGROUND OF THE INVENTION 1. (Field of the invention)

This invention relates to a starting electric motor for starting an engine, and more particularly to an improvement of the pinion shafting structure in an overhang type starting electric motor in which a hollow movable pinion cylinder engageable with a ring gear of an engine is moved axially in the front bracket.

2. (Prior art)

FIG. 1 is a sectional view showing the pinion shafting structure in a conventional starting electric motor disclosed, for instance, in Japanese Utility Model Application (OPI) No. 6679/1986 (the term "OPI" as used herein means an "unexamined published application").

As shown in FIG. 1, a rotary output shaft 1 of the motor includes a spline part 1*a* having a helical spline, and a small diameter part 1*c*. An overrunning clutch 10 movable on the output shaft 1 back and forth comprises a movable pinion cylinder 2, a clutch outer 8, and rollers 9. The movable pinion cylinder 2 comprises; a clutch inner part 2*a;* a cylindrical part 2*b* slidably fitted in a bearing 4 which is fixedly fitted in a front bracket 12; and a pinion part 2*c* engageable with a ring gear 20 of an engine.

Further in FIG. 1, reference numeral 5 designates a dust protective cap; 6 and 7, parts forming a stopper structure for the movable pinion cylinder 2; and 3, oil-impregnated bearings fitted in the movable pinion cylinder 2 in such a manner that they are located at the cylindrical part 2*b* and the pinion part 2*c*.

The operation of the starting electric motor thus constructed will be described. Upon application of voltage to a magnet switch (not shown), a plunger is attracted, so that the overrunning clutch 10 is moved forwardly through a lever. As a result, the movable pinion cylinder 2, being engaged with the overrunning clutch 10, is engaged with the ring gear 20 of the engine, while the contact means (not shown) of the magnet switch is closed to supply current from a battery. Consequently, an armature of the DC motor is started, and the ring gear 20 of the engine is driven. At the same time, the front end of the movable pinion cylinder 2 abuts against the stopper 6 and the movable pinion cylinder 2 is stopped.

The conventional starting electric motor is constructed as described above. Therefore, the grease applied to the oil-impregnated bearings 3 are liable to be moved along the armature rotary shaft 1 forwardly or backwardly, with the result that the service lives of the bearings 3 are shortened as much. Furthermore, the conventional starting electric motor suffers from the following problems: In the case where it is required to extend the rotary shaft 1 through the pinion part 2*c* of the movable pinion cylinder 2 with the tooth form of the pinion formed at the pinion part made smaller or with the number of teeth reduced, either the thickness of the teeth base of the pinion or the diameter of the rotary shaft must be reduced, with the result that the mechanical strength thereof is unavoidably reduced. On the other hand, the clutch inner part 2*a* and the clutch outer 8 become out of alignment, thus shortening the service life of the overrunning clutch.

SUMMARY OF THE INVENTION

Accordingly, an object of this invention is to eliminate the above-described difficulties accompanying a conventional starting electric motor.

More specifically, an object of the invention is to provide a starting electric motor in which the bearings are long in service life, the pinion and the rotary shaft are high in mechanical strength, and the overrunning clutch has a long service life.

The foregoing object and other objects of the invention have been achieved by the provision of a starting electric motor in which a hollow movable pinion cylinder engageable with the ring gear of an engine is mounted on the rotary shaft of the motor and is slidable along a first bearing fitted in the front bracket of the motor, in which, according to the invention, the movable pinion cylinder comprises: a clutch inner part forming a part of an overrunning clutch; a cylindrical part slidable in the first bearing; and a pinion part engageable with the ring gear, the pinion part being smaller in inside diameter than the clutch inner part and the cylindrical part, the rotary shaft comprises a helical spline part; a small diameter part on which a second bearing fitted in the inner cylindrical wall of the cylindrical part of the movable pinion cylinder is slidable; and a stepped part between the helical spline part and the small diameter part, in such a manner that a minute gap is formed between the stepped part of the rotary shaft and the inner cylindrical wall of the clutch inner part of the movable pinion cylinder, and a minute gap is formed between the small diameter part of the rotary shaft and the inner cylindrical wall of the pinion part of the movable pinion cylinder, and a misalignment preventing ring fitted in the clutch outer of the overrunning clutch is slidable mounted on the stepped part of the movable pinion cylinder.

In the pinion shifting structure according to the invention, the minute or very small gaps are provided on both sides of the bearing mounted on the small diameter part of the rotary shaft, so that the grease lubricating oil applied to the bearing is scarcely moved along the rotary shaft forwardly or backwardly.

Furthermore, no bearing is provided at the pinion part of the movable pinion cylinder which is strictly limited in dimension, and therefore the diameter of the rotary shaft can be so selected as to be effective in increasing the mechanical strength, and the thickness of the teeth base of the pinion can be increased. Moreover, the bearing is set close to the section of the rotary shaft which is dangerous from the view point of mechanical strength, thereby to reduce the bending moment applied thereto, and the rotary shaft has the stepped part between the small diameter part and the helical spline part so that the rotary shaft is increased in diameter. Thus, in the starting electric motor of the invention, the rotary shaft is sufficiently high in mechanical strength Furthermore, the misalignment preventing ring is mounted on the stepped part of the rotary shaft, thus preventing the flow of grease from the bearing and the misalignment of the overrunning clutch.

The nature, principle and utility of the invention will become more apparent from the following detailed description when read in conjunction with the accompanying drawings.

DETAILED DESCRIPTION OF THE PREFERRED EMBODIMENT

One example of a starting electric motor according to this invention will be described with reference to FIG. 2.

Figure 1:
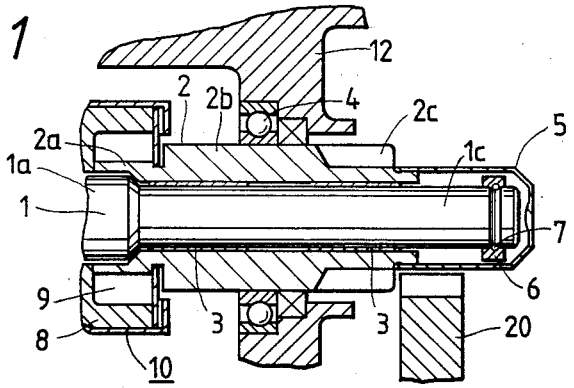
FIG. 1 PRIOR ART
FIG. 1 is a sectional view showing essential components of a conventional starting electric motor.
Figure 2:
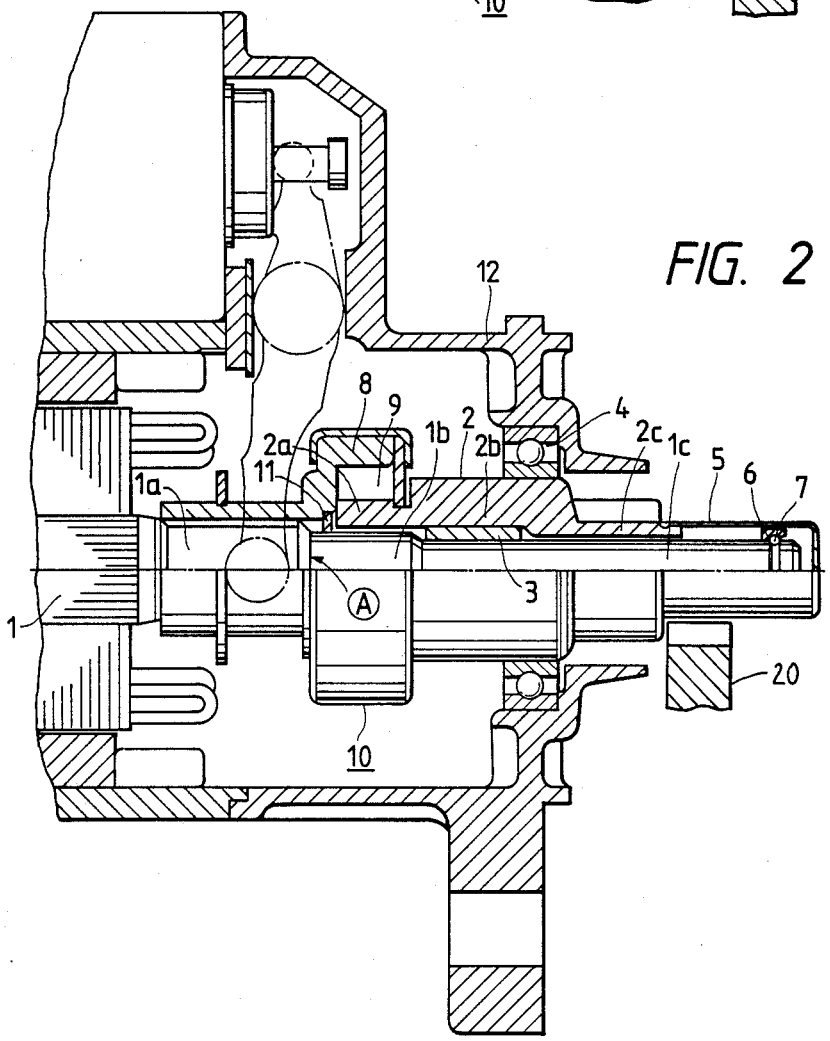
FIG. 2 is a sectional view showing essential components of a starting electric motor according to an embodiment of this invention.
Figure 3:
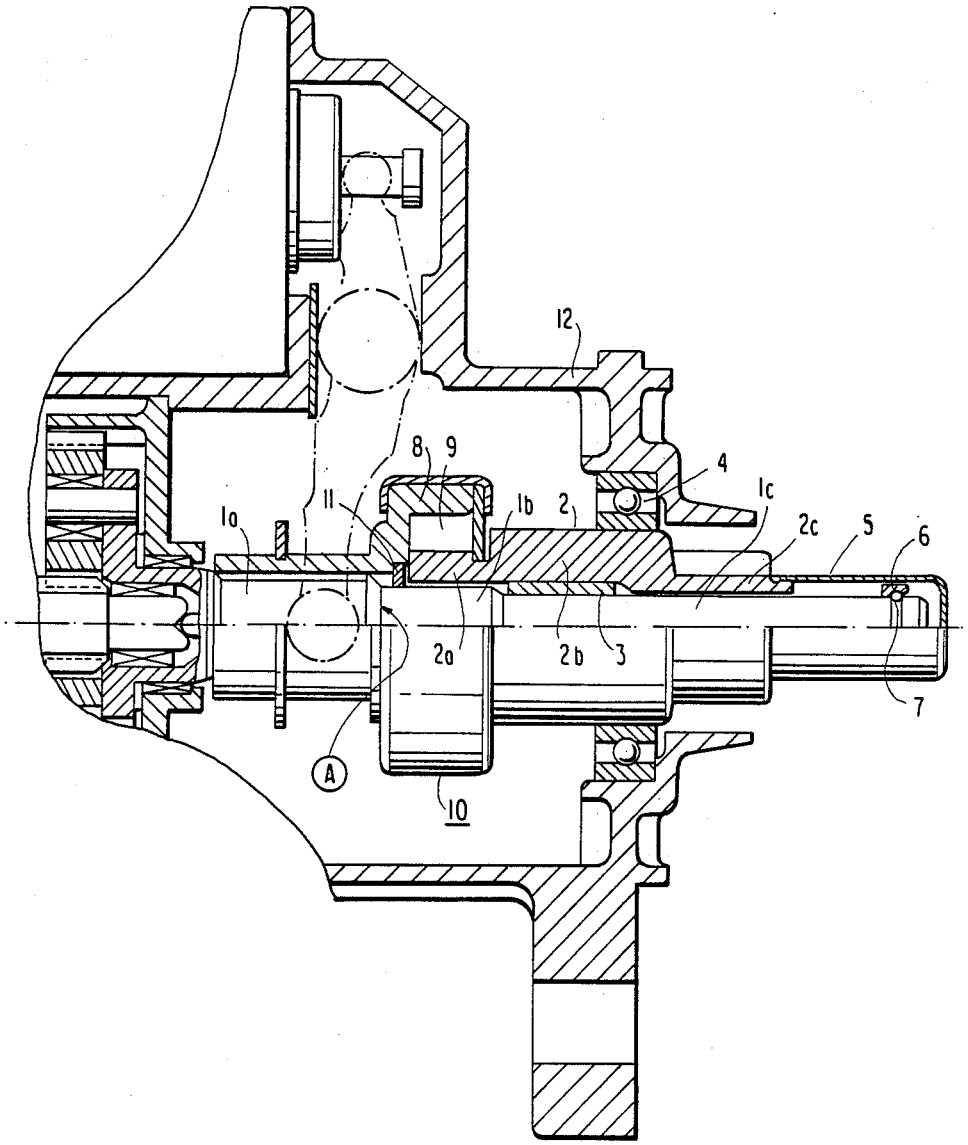
FIG. 3 is a view similar to FIG. 2 but showing an electric motor of the internal speed reduction type.

In FIG. 2, reference numeral 1 designates an armature rotary shaft of the motor. The armature rotary shaft 1 has a front end portion formed into a helical spline part 1*a* which is engaged with a helical spline formed on a clutch outer 8 of an overrunning clutch 10, a small diameter part 1*c* on which an oil-impregnated bearing 3 fitted in the inner cylindrical wall of a cylindrical part 2*b* of a movable pinion cylinder 2 is slidably moved, and a stepped part 1*b* between the spline part 1*a* and the small diameter par 1*c*, the stepped part 1*b* being smaller in diameter than the spline part 1*a* and larger in diameter than the small diameter part 1*c*. Accordingly, a minute gap is formed between the stepped part 1*b* and the inner cylindrical wall of the clutch inner part 2*a* of the movable pinion cylinder 2, and a minute gap is also formed between the small diameter part 1*c* and the inner cylindrical wall of the pinion part 2*c* of the movable pinion cylinder 2. In FIG. 2, reference character (A) designates a section of the shaft which is dangerous in view of mechanical strength; and 11, a ring fitted in the clutch outer 8 in such a manner that it is slidable on the stepped part 1*b* with a very small clearance between the ring 11 and the stepped part 1*b*.

In the starting electric motor thus constructed, the radial gap between the cylindrical wall of the stepped part 1*b* of the rotary shaft 1 and the inner cylindrical wall of the clutch inner part 2*a* of the movable pinion cylinder 2 is made very small, and the radial gap between the cylindrical wall of the small diameter part 1*c* of the rotary shaft 1 and the inner cylindrical wall of the pinion part 2*c* of the movable pinion cylinder 2 is also made very small; that is, the front and rear gaps on the rotary shaft 1, on which the oil-impregnated bearing is mounted are made very small. Therefore, the oil-impregnated in the bearing 3 and the grease applied thereto scarcely leak through the gaps; that is, the large parts of them remain in the radial gap between the small diameter part 1*c* of the rotary shaft 1 and the cylindrical part 2*b* of the movable pinion cylinder 2, with the result that the service life of the oil-impregnated bearing 3 is increased as much.

The oil-impregnated bearing 3 is set close to the section A of the rotary shaft 1 which is dangerous from the view point of mechanical strength, thereby to decrease the bending moment. The rotary shaft 1 has the stepped part 1*b*, and the small diameter part 1*c* according to the invention, and the stepped part 1*b* can be made large in diameter. This will greatly contribute to increase of the mechanical strength.

The rotary shaft 1 has the small diameter part 1*c*, as was described above. Therefore, even when the tooth form of the pinion of the movable pinion cylinder is made smaller, or the number of teeth thereof is reduced, the teeth base of the pinion can be made sufficiently large in thickness; that is, the mechanical strength of the pinion can be maintained unchanged.

The ring 11 for preventing misalignment is fitted in the clutch outer 8 in such a manner that the ring 11 is slidable on the stepped part 1*b* of the rotary shaft 1. Therefore, the flow of grease from the oil-impregnated bearing 3 is blocked by the misalignment preventing ring 1, and the misalignment of the clutch inner part 2*a* and the clutch outer 8 is prevented by the ring 11, with the result that the service life of the overrunning clutch is increased as much.

In the above-described embodiment, the dust protective cover 5 is secured to the end of the movable pinion cylinder 2; however, it should be noted that the technical concept of the invention is applicable to a starting electric motor in which the movable pinion cylinder has no dust protective cap.

While the starting electric motor the output shaft of which is the armature rotary shaft has been described, the technical concept of the invention is applicable to a starting electric motor of internal speed reduction type in which the rotary shaft penetrating the movable pinion cylinder 2 is provided separately from the armature rotary shaft.

As was described above, in the starting electric motor of the invention, the very small gaps are provided, on both sides of the bearing, between the rotary shaft and the movable pinion cylinder, whereby the flow of grease from the bearing can be reduced. Furthermore, the bearing is set close to the dangerous section of the rotary shaft, and the shaft diameter is increased, whereby the bending stress in the dangerous section is reduced, and the misalignment of the overrunning clutch is prevented, with the result that the service life thereof is increased as much. Thus, the starting electric motor according to the invention is high in reliability.

What is claimed is:

1. A starting electric motor of an overhang type, comprising:

a front bracket;

a first bearing fitted in said front bracket;

an overrunning clutch having a clutch outer with a helical spline;

a rotary shaft including a helical spline part engaged with the helical spline of said clutch outer, a small diameter part smaller in diameter than said helical spline part, and a stepped part provided between said helical spline part and said small diameter part, said stepped part being smaller in diameter than said spline part and larger than in diameter than said small diameter part;

a hollow movable pinion cylinder mounted on said rotary shaft and engageable with a ring gear of an engine, said hollow movable pinion cylinder including a clutch inner part having an inner wall and forming a part of said overrunning clutch, a cylindrical part having an inner wall and axially slidable in said first bearing, and a pinion part having an inner wall and engageable with said ring gear, said pinion part being smaller in inner diameter than said clutch inner part and said cylindrical part;

a second bearing fitted in the inner wall of said cylindrical part of said movable pinion cylinder and slidable on said small diameter part of said rotary shaft, in which a first minute gap is provided between said small diameter part of said rotary shaft and the inner wall of said pinion part of said movable pinion cylinder, a second minute gap is provided between said stepped part of said rotary shaft and said inner wall of said clutch inner part of said hollow movable pinion cylinder, and a third gap between said small diameter part of said rotary shaft and said inner wall of said cylindrical part of said movable pinion cylinder and housing said second bearing, with said first and second gaps being smaller than said third gap.

2. A starting electric motor as claimed in claim 1, in which a second minute gap is provided between said stepped part of said rotary shaft and the inner wall of said clutch inner of said hollow movable pinion cylinder.

3. A starting electric motor as claimed in claim 1, in which said second bearing is impregnated with lubricating oil.

4. A starting electric motor as claimed in claim 1, in which said rotary shaft is constituted by an armature rotary shaft.

5. A starting electric motor as claimed in claim 1, in which said rotary shaft is provided separately from an armature rotary shaft.

6. A starting electric motor as claimed in claim 1, further comprising a dust protective cover which is secured to an end of said movable pinion cylinder.

7. A starting electric motor of an overhand type, comprising:

a front bracket;

a first bearing fitted in said front bracket;

an overrunning clutch having a clutch outer with a helical spline;

a rotary shaft including a helical spline part engaged with the helical spline of said clutch outer, a small diameter part smaller in diameter than said helical spline part, and a stepped part provided between said helical spline part and said small diameter part, said stepped part being smaller in diameter than said spline part and larger than in diameter than said small diameter part;

a hollow movable pinion cylinder mounted on said rotary shaft and engageable with a ring gear of an engine, said hollow movable pinion cylinder including a clutch inner part having an inner wall and forming a part of said overrunning clutch, a cylindrical part having an inner wall and axially slidable in said first bearing, and a pinion part having an inner wall and engageable with said ring gear, said pinion part being smaller in inner diameter than said clutch inner part and said cylindrical part;

a second bearing fitted in the inner wall of said cylindrical part of said movable pinion cylinder and slidable on said small diameter part of said rotary shaft, in which a first minute gap is provided between said small diameter part of said rotary shaft and the inner wall of said pinion part of said movable pinion cylinder; and a misalignment preventing ring fitted in said clutch outer of said overrunning clutch and slidably mounted on said stepped part of said rotary shaft.

* * * * *